US007306825B2

(12) United States Patent
Mobley et al.

(10) Patent No.: US 7,306,825 B2
(45) Date of Patent: Dec. 11, 2007

(54) PROCESS TO MAKE SYNTHETIC LEATHER AND SYNTHETIC LEATHER MADE THEREFROM

(75) Inventors: Larry Wayne Mobley, Cohutta, GA (US); Ramki Subramanian, Pearland, TX (US); Kenneth W. Skaggs, Lake Jackson, TX (US); Weijun Zhou, Houston, TX (US); Debkumar Bhattacharjee, Lake Jackson, TX (US); Roger Moore, San Antonio, TX (US)

(73) Assignee: Dow Global Technologies Inc., Midland, MI (US)

( * ) Notice: Subject to any disclaimer, the term of this patent is extended or adjusted under 35 U.S.C. 154(b) by 329 days.

(21) Appl. No.: 10/609,179

(22) Filed: Jun. 27, 2003

(65) Prior Publication Data

US 2004/0121113 A1 Jun. 24, 2004

Related U.S. Application Data

(60) Provisional application No. 60/435,823, filed on Dec. 20, 2002.

(51) Int. Cl.
*B05D 5/00* (2006.01)
*B05D 3/10* (2006.01)
*C08C 1/14* (2006.01)

(52) U.S. Cl. ..... 427/246; 427/394; 427/341; 523/335

(58) Field of Classification Search ..... 427/246, 427/394, 341; 523/335
See application file for complete search history.

(56) References Cited

U.S. PATENT DOCUMENTS 2,968,575 A * 1/1961 Mallonee ..... 524/839
3,169,885 A * 2/1965 Golodner et al. ..... 427/245
3,294,724 A 12/1966 Axelrood ..... 260/29.2
3,410,817 A 11/1968 McClellan, Jr. et al. ... 260/29.2
3,412,054 A 11/1968 Milligan ..... 260/18
3,598,780 A * 8/1971 Shkapenko et al. ..... 524/391
3,772,059 A * 11/1973 Shikada ..... 427/246
3,905,929 A 9/1975 Noll ..... 260/29.2
3,920,598 A 11/1975 Reiff et al. ..... 260/29.2
4,171,391 A 10/1979 Parker ..... 427/246
4,376,148 A 3/1983 McCartney ..... 428/198
4,496,624 A 1/1985 McCartney ..... 428/288
4,833,173 A * 5/1989 Spek et al. ..... 521/72
5,539,021 A * 7/1996 Pate et al. ..... 523/335
5,688,842 A * 11/1997 Pate, III et al. ..... 523/335

(Continued)

FOREIGN PATENT DOCUMENTS

CS 210523 5/1981

(Continued)

OTHER PUBLICATIONS

Research Disclosure 25229, Dated Apr. 1985, pp. 185-186.

*Primary Examiner*—William Phillip Fletcher, III
*Assistant Examiner*—Cachet I Sellman

(57) ABSTRACT

A synthetic leather is made by a impregnating a non-woven or woven textile with an aqueous polyurethane dispersion comprised of a nonionizable polyurethane and an external stabilizing surfactant. The impregnated textile is then exposed to water containing a coagulant for a coagulation time sufficient to coagulate the dispersion. The method may be used to form a synthetic leather having excellent wet ply adhesion and may contain an insoluble multivalent cation organic acid.

15 Claims, 3 Drawing Sheets

U.S. PATENT DOCUMENTS

| | | | | |
|---|---|---|---|---|
| 5,859,111 | A * | 1/1999 | Kukkala et al. | 524/458 |
| 5,959,027 | A * | 9/1999 | Jakubowski et al. | 524/839 |
| 6,231,926 | B1 | 5/2001 | Ronzani et al. | 427/341 |
| 6,271,276 | B1 | 8/2001 | Gribble et al. | 521/133 |
| 6,322,851 | B1 | 11/2001 | Adachi et al. | 427/246 |
| 6,451,908 | B1 * | 9/2002 | Koonce et al. | 524/591 |
| 6,642,303 | B2 | 11/2003 | Schutze et al. | 524/589 |
| 6,649,273 | B2 * | 11/2003 | Iwato et al. | 428/448 |
| 2004/0109992 | A1 * | 6/2004 | Gribble et al. | 428/315.9 |
| 2004/0253370 | A1 * | 12/2004 | Hoersch | 427/175 |

FOREIGN PATENT DOCUMENTS

| | | | |
|---|---|---|---|
| DE | 1943975 | | 8/1969 |
| DE | 2035730 | | 1/1972 |
| DE | 2502468 | | 7/1975 |
| DE | 2951348 | A1 | 12/1979 |
| EP | 0 411 236 | A2 | 2/1990 |
| EP | 0122554 | B1 | 3/1990 |
| EP | 411236 | | 1/1996 |
| EP | 0969139 | A2 | 1/2000 |
| FR | 2007794 | | 1/1970 |
| JP | 48005886 | | 2/1973 |
| JP | 52119697 | | 10/1977 |
| JP | 53009301 | | 1/1978 |
| JP | 53101061 | | 9/1978 |
| JP | 56159213 | | 5/1980 |
| JP | 55122081 | | 9/1980 |
| JP | 62174114 | | 1/1986 |
| JP | 61239084 | | 10/1986 |
| JP | H6-294077 | | 11/1993 |
| JP | 2000-345026 | | 12/2000 |
| JP | 2000-355885 | A | 12/2000 |
| WO | WO 99/18281 | | 4/1999 |
| WO | WO 00/61651 | | 10/2000 |
| WO | 02/00425 | A1 | 3/2002 |
| WO | 02/00431 | A1 | 3/2002 |
| WO | 02/33001 | A1 | 4/2002 |
| WO | WO 02/33001 | A1 | 4/2002 |

* cited by examiner

PROCESS TO MAKE SYNTHETIC LEATHER AND SYNTHETIC LEATHER MADE THEREFROM

This application claims the benefit of U.S. Provisional Application No. 60/435,823 filed on Dec. 20, 2002.

FIELD OF THE INVENTION

The invention relates to improved method of making synthetic leather. In particular, the invention relates to synthetic leather using aqueous polyurethane dispersions.

BACKGROUND OF THE INVENTION

Synthetic leather or imitation leather is a woven or non-woven textile that is impregnated with a polymer such as polyurethane that may have a porous polymer coating (poromeric) layer thereon.

Synthetic leather is typically made by impregnating non-woven textiles with polyurethane to bond the material and give it the mechanical properties and feel (hand) similar to real leather. Generally, synthetic leather is made using an organic solvent by a wet coagulation or dry coagulation process. In the wet coagulation process, the textile is impregnated with a polyurethane dissolved in a volatile organic solvent such as dimethylformamide (DMF) and the polyurethane is coagulated in a non-solvent such as water, and the solvent is extracted by the water. In the dry coagulation process, the textile is impregnated, for example, with polyurethane dissolved in an organic solvent and impregnated textile is subsequently dried. Because of the organic solvent, a porous flexible structure is developed upon coagulation resulting in a flexible leatherlike material.

These methods, even though they give a useful synthetic leather, require excessive amounts of volatile organic solvents, which are released to the environment or require expensive recovery systems. In addition, because the removal and distribution of the solvent that causes the porous structure is difficult to control, the resultant synthetic layer typically does not have a well defined porous structure leading to variations of the synthetic leather.

To remedy these problems, attempts have been made to replace the solvent based processes using aqueous polyurethane dispersions to impregnate the textile and make the porous coating layer when desired. Early examples such as U.S. Pat. Nos. 4,171,391 and 4,376,148 describe internally stabilized polyurethane dispersions (e.g., anionic internally stabilized using 2,2-di-(hydroxymethyl) propionic acid) impregnated into a textile. These dispersions were coagulated using a weak acid such as acetic acid to avoid contamination and unsatisfactory coagulation. Consequently, the coagulation times were long, for example, 5 to 10 minutes. The synthetic leather that was formed was stiff resembling cellulose cardboard. Externally stabilized polyurethane dispersions were avoided because of the need to use large amounts of surfactant, which were deleterious to the synthetic leather.

Another example, U.S. Pat. No. 4,496,624, describes anionic internally stabilized polyurethane dispersions blended with other polymeric dispersions (e.g., vinylchoride/vinylidene chloride copolymer) impregnated into textiles and coagulated using sodium silicofluoride and hot water (e.g., 200° F.). The impregnated sheet was then dried. The dried impregnated sheet was boardy. The dried sheet was then pressed at an elevated temperature (e.g., 275° F.). The heated and pressed sheet was soft and pliable.

A recent example, U.S. Pat. No. 6,231,926, also describes impregnating a textile with an internally stabilized aqueous polyurethane dispersion until the textile is completely impregnated. The impregnated textile is dried. The dried impregnated textile is subjected to a caustic solution to remove some of the polyurethane impregnated into the textile to achieve a satisfactory hand.

Another recent example, WO 02/33001, describes an anionic internally stabilized polyurethane impregnated into a textile and formation of a porous layer. The method requires an antifoam and water repellant for the impregnating dispersion. Coagulation time was 5 minutes or more.

Accordingly, it would be desirable to provide a synthetic leather and method to form the synthetic leather that avoids one or more of the problems in the prior art such as one of those described above (e.g., use of organic solvents, slow coagulation times, use of hazardous or caustic chemicals to coagulate, use of expensive additives and extra processing steps such as caustic leaching).

SUMMARY OF THE INVENTION

A first aspect of the invention is a method for making an impregnated textile synthetic leather, the method comprising:

(a) impregnating a non-woven or woven textile with a polyurethane dispersion comprised of a nonionizable polyurethane and an external stabilizing surfactant; and (b) exposing the impregnated textile to water containing a coagulant for a coagulation time sufficient to coagulate the dispersion.

This improved method for making synthetic leather employs an aqueous polyurethane dispersion that is able to be quickly coagulated, for example, by the mere addition of a neutral salt. In particular, the method preferably uses a polyurethane dispersion that is solely externally stabilized. The addition of a neutral salt not only may coagulate the polyurethane dispersion, but may react with one or more additives (e.g., surfactants) to cause the additive to form a water insoluble compound. It has been surprisingly found that the use of such a method allows for the rapid production of synthetic leather having good hand and softness due to the microstructures developed. In addition, the resultant water insoluble compound may impart desired properties such as water repellency to the synthetic leather.

A second aspect of the invention is a method for making synthetic leather having a poromeric layer thereon, the method comprising:

(a) applying onto a textile, impregnated with a polymer, a frothed aqueous polyurethane dispersion, the aqueous polyurethane dispersion having an external stabilizing surfactant; and then (b) heating to a temperature sufficient to dry and cure the product of step (a) to form the synthetic leather having a poromeric layer.

The method of the second aspect has been found to form a poromeric layer on an impregnated textile that has a uniform porous structure that has good hand and appearance. Surprisingly, the synthetic leather may be formed using a polyurethane dispersion having an external stabilizing surfactant by simply heating without using an added coagulant. In particular, it has been discovered that the use of an aqueous polyurethane dispersion having an external stabilizing surfactant allows, for example, the leaching of the dried synthetic leather to form a synthetic leather that has excellent hand and properties and a non-shiny appearance.

A third aspect of the invention is a synthetic leather comprised of a textile having a plurality of fibers wherein the textile has therein a polyurethane and a multivalent cation substantially water insoluble salt of an organic acid. Substantially water insoluble means the compound is at most only slightly soluble in water (e.g., less than 1% soluble in water). Preferably, the compound is insoluble.

A fourth aspect of the invention is a synthetic leather comprised of a textile having poromeric layer comprised of polyurethane thereon wherein the synthetic leather has at least a trace amount of a surfactant to at most about 4% by weight of the poromeric layer, and a wet ply adhesion of at least about 1.5 kg/cm as determined by a method described herein. In a preferred embodiment of the fourth aspect, the textile is impregnated with a polymer such as the one formed in the first aspect of the invention.

The synthetic leather and process to make it may be used to make synthetic leather for any leather or synthetic leather applications. Particular examples include footwear, handbags, belts, purses, garments, furniture upholstery and automotive upholstery, and gloves.

Definitions

An internally stabilized polyurethane dispersion is one that is stabilized through the incorporation of ionically or nonionically hydrophilic pendant groups within the polyurethane of the particles dispersed in the liquid medium. Examples of nonionic internally stabilized polyurethane dispersions are described by U.S. Pat. Nos. 3,905,929 and 3,920,598. Ionic internally stabilized polyurethane dispersions are well known and are described in col. 5, lines 4-68 and col. 6, lines 1 and 2 of U.S. Pat. No. 6,231,926. Typically, dihydroxyalkylcarboxylic acids such as described by U.S. Pat. No. 3,412,054 are used to make anionic internally stabilized polyurethane dispersions. A common monomer used to make an anionic internally stabilized polyurethane dispersion is dimethylolpropionic acid (DMPA).

An externally stabilized polyurethane dispersion is one that substantially fails to have an ionic or nonionic hydrophilic pendant groups and thus requires the addition of a surfactant to stabilize the polyurethane dispersion. Examples of externally stabilized polyurethane dispersions are described in U.S. Pat. Nos. 2,968,575; 5,539,021; 5,688,842 and 5,959,027.

DETAILED DESCRIPTION OF THE INVENTION

Figure 1:
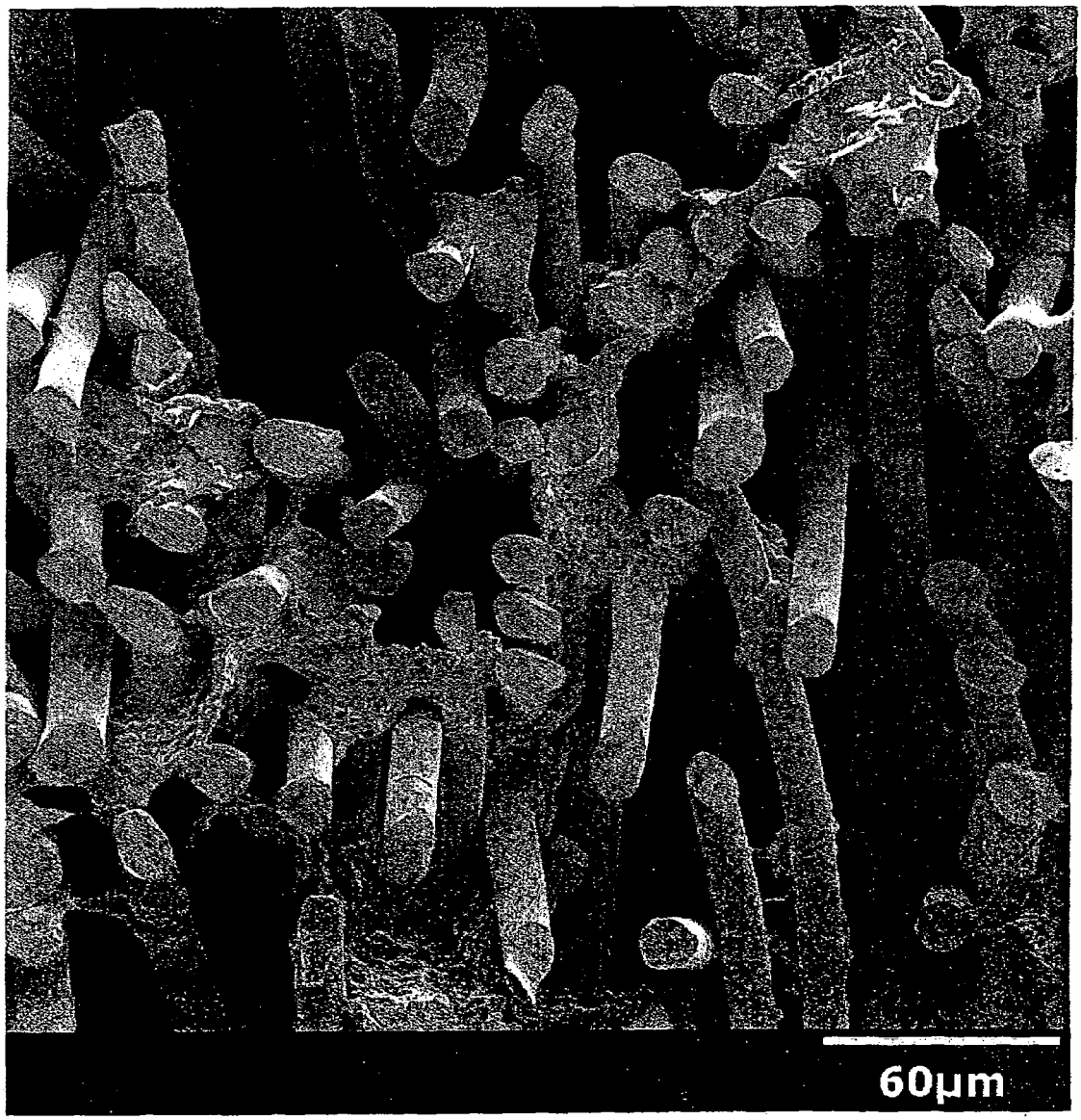
FIG. 1 is an SEM micrograph of a synthetic leather of the present invention where the textile was impregnated with an aqueous polyurethane dispersion that was coagulated in about 5 seconds using a 10% by weight calcium nitrate aqueous solution.

A synthetic leather having a soft supple touch (hand) is made by impregnating a non-woven or woven textile with an aqueous polyurethane dispersion and then exposing the impregnated textile to water containing a coagulant for a coagulation time sufficient to coagulate the dispersion. The polyurethane dispersion is comprised of a nonionizable polyurethane and an external stabilizing surfactant further described below.

The textile may be woven or nonwoven. Preferably, the textile is a nonwoven textile. The textile may be made by any suitable method such as those known in the art. The textile may be prepared from any suitable fibrous material. Suitable fibrous materials include, but are not limited to, synthetic fibrous materials and natural or semi synthetic fibrous materials and mixtures or blends thereof. Examples of synthetic fibrous materials include polyesters, polyamides, acrylics, polyolefins, polyvinyl chlorides, polyvinylidene chlorides, polyvinyl alcohols and blends or mixtures thereof. Examples of natural semi-synthetic fibrous materials include cotton, wool and hemp.

The aqueous polyurethane dispersion is impregnated by any suitable method such as those known in the art. Examples include dipping, spraying or doctor blading. After impregnating, the impregnated textile may have excess dispersion or water removed to leave the desired amount of dispersion within the textile. Typically, this may be accomplished by passing the impregnated textile through rubber rollers.

The aqueous polyurethane dispersion is one in which the dispersion is substantially free of organic solvents. Organic solvent means organic compounds typically used as solvents. Generally, organic solvents display a heightened flammability and vapor pressure (i.e., greater than about 0.1 mm of Hg). Substantially free of organic solvents means that the dispersion was made without any intentional addition of organic solvents to make the prepolymer or the dispersion. That is not to say that some amount of solvent may be present due to unintentional sources such as contamination from cleaning the reactor. Generally, the aqueous dispersion has at most about 1 percent by weight of the total weight of the dispersion. Preferably, the aqueous dispersion has at most about 2000 parts per million by weight (ppm), more preferably at most about 1000 ppm, even more preferably at most about 500 ppm and most preferably at most a trace amount of a solvent. In a preferred embodiment, no organic solvent is used, and the aqueous dispersion has no detectable organic solvent present (i.e., "essentially free" of an organic solvent).

To reiterate, the polyurethane dispersion is comprised of a nonionizable polyurethane and an external stabilizing surfactant. A nonionizable polyurethane is one that does not contain a hydrophilic ionizable group. A hydrophilic ionizable group is one that is readily ionized in water such as DMPA. Examples of other ionizable groups include anionic groups such as carboxylic acids, sulfonic acids and alkali metal salts thereof. Examples of cationic groups include ammonium salts reaction of a tertiary amine and strong mineral acids such as phosphoric acid, sulfuric acid, hydrohalic acids or strong organic acids or by reaction with suitable quartinizing agents such as C1-C6 alkyl halides or benzyl halides (e.g., Br or Cl).

The nonionizable polyurethane dispersion may be mixed with other dispersions so long as the dispersion is easily and quickly coagulated as described below. The nonionizable dispersion may even be mixed with an internally stabilized polyurethane dispersion so long as the overall dispersion is easily coagulated, for example, by exposing the dispersion to water containing a neutral salt. Other polymer dispersions or emulsions that may be useful when mixed with the nonionizable polyurethane dispersion include polymers such as polyacrylates, polyisoprene, polyolefins, polyvinyl alcohol, nitrile rubber, natural rubber and co-polymers of styrene and butadiene. Most preferably, the nonionizable dispersion is used alone (i.e., not mixed with any other polymeric dispersion or emulsion).

Generally, the nonionizable polyurethane is prepared by reacting a polyurethane/urea/thiourea prepolymer with a chain-extending reagent in an aqueous medium and in the presence of a stabilizing amount of an external surfactant. The polyurethane/urea/thiourea prepolymer can be prepared by any suitable method such as those well known in the art. The prepolymer is advantageously prepared by contacting a high molecular weight organic compound having at least two active hydrogen atoms with sufficient polyisocyanate, and under such conditions to ensure that the prepolymer is terminated with at least two isocyanate groups.

The polyisocyanate is preferably an organic diisocyanate, and may be aromatic, aliphatic, or cycloaliphatic, or a combination thereof. Representative examples of diisocyanates suitable for the preparation of the prepolymer include those disclosed in U.S. Pat. No. 3,294,724, column 1, lines 55 to 72, and column 2, lines 1 to 9, incorporated herein by reference, as well as U.S. Pat. No. 3,410,817, column 2, lines 62 to 72, and column 3, lines 1 to 24, also incorporated herein by reference. Preferred diisocyanates include 4,4'-diisocyanatodiphenylmethane, 2,4'-diisocyanatodiphenylmethane, isophorone diisocyanate, p-phenylene diisocyanate, 2,6 toluene diisocyanate, polyphenyl polymethylene polyisocyanate, 1,3-bis(isocyanatomethyl)cyclohexane, 1,4-diisocyanatocyclohexane, hexamethylene diisocyanate, 1,5-naphthalene diisocyanate, 3,3'-dimethyl-4,4'-biphenyl diisocyanate, 4,4'-diisocyanatodicyclohexylmethane, 2,4'-diisocyanatodicyclohexylmethane, and 2,4-toluene diisocyanate, or combinations thereof. More preferred diisocyanates are 4,4'-diisocyanatodicyclohexylmethane, 4,4'-diisocyanatodiphenylmethane, 2,4'-diisocyanatodi-cyclohexylmethane, and 2,4'-diisocyanatodiphenylmethane. Most preferred is 4,4'-diisocyanatodiphenylmethane and 2,4'-diisocyanatodiphenylmethane.

As used herein, the term "active hydrogen group" refers to a group that reacts with an isocyanate group to form a urea group, a thiourea group, or a urethane group as illustrated by the general reaction:

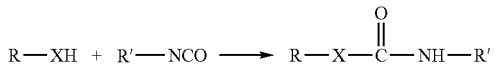

where X is O, S, NH, or N, and R and R' are connecting groups which may be aliphatic, aromatic, or cycloaliphatic, or combinations thereof. The high molecular weight organic compound with at least two active hydrogen atoms typically has a molecular weight of not less than 500 Daltons.

The high molecular weight organic compound having at least two active hydrogen atoms may be a polyol, a polyamine, a polythiol, or a compound containing combinations of amines, thiols, and ethers. Depending on the properties desired the polyol, polyamine, or polythiol compound may be primarily a diol, triol or polyol having greater active hydrogen functionality or a mixture thereof. It is also understood that these mixtures may have an overall active hydrogen functionality that is slightly below 2, for example, due to a small amount of monol in a polyol mixture.

As an illustration, it is preferred to use a high molecular weight compound or mixtures of compounds having an active hydrogen functionality of about 2 for an impregnating polyurethane dispersion whereas a higher functionality is typically more desirable for a polyurethane dispersion used to make a poromeric layer. The high molecular weight organic compound having at least two active hydrogen atoms may be a polyol (e.g, diol), a polyamine (e.g., diamine), a polythiol (e.g., dithiol) or mixtures of these (e.g., an alcohol-amine, a thiol-amine, or an alcohol-thiol). Typically the compound has a weight average molecular weight of at least about 500.

Preferably, the high molecular weight organic compound having at least two active hydrogen atoms is a polyalkylene glycol ether or thioether or polyester polyol or polythiol having the general formula:

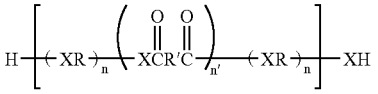

where each R is independently an alkylene radical; R' is an alkylene or an arylene radical; each X is independently S or O, preferably O; n is a positive integer; and n, is a non-negative integer.

Generally, the high molecular weight organic compound having at least two active hydrogen atoms has a weight average molecular weight of at least about 500 Daltons, preferably at least about 750 Daltons, and more preferably at least about 1000 Daltons. Preferably, the weight average molecular weight is at most about 20,000 Daltons, more preferably at most about 10,000 Daltons, more preferably at most about 5000 Daltons, and most preferably at most about 3000 Daltons.

Polyalkylene ether glycols and polyester polyols are preferred, for example, for making a polyurethane dispersion for impregnating the textile. Representative examples of polyalkylene ether glycols are polyethylene ether glycols, poly-1,2-propylene ether glycols, polytetramethylene ether glycols, poly-1,2-dimethylethylene ether glycols, poly-1,2-butylene ether glycol, and polydecamethylene ether glycols. Preferred polyester polyols include polybutylene adipate, caprolactone based polyester polyol and polyethylene terephthalate.

Preferably, the NCO:XH ratio, where X is O or S, preferably O, is not less than 1.1:1, more preferably not less than 1.2:1, and preferably not greater than 5:1.

The polyurethane prepolymer may be prepared by a batch or a continuous process. Useful methods include methods such as those known in the art. For example, a stoichiometric excess of a diisocyanate and a polyol can be introduced in separate streams into a static or an active mixer at a temperature suitable for controlled reaction of the reagents, typically from about 40° C. to about 100° C. A catalyst may be used to facilitate the reaction of the reagents such as an organotin catalyst (e.g., stannous octoate). The reaction is generally carried to substantial completion in a mixing tank to form the prepolymer.

The external stabilizing surfactant may be cationic, anionic, or nonionic. Suitable classes of surfactants include, but are not restricted to, sulfates of ethoxylated phenols such as poly(oxy-1,2-ethanediyl)α-sulfo-ω(nonylphenoxy) ammonium salt; alkali metal fatty acid salts such as alkali metal oleates and stearates; polyoxyalkylene nonionics such as polyethylene oxide, polypropylene oxide, polybutylene oxide, and copolymers thereof; alcohol alkoxylates; ethoxylated fatty acid esters and alkylphenol ethoxylates; alkali metal lauryl sulfates; amine lauryl sulfates such as triethanolamine lauryl sulfate; quaternary ammonium surfactants; alkali metal alkylbenzene sulfonates such as branched and linear sodium dodecylbenzene sulfonates; amine alkyl benzene sulfonates such as triethanolamine dodecylbenzene sulfonate; anionic and nonionic fluorocarbon surfactants such as fluorinated alkyl esters and alkali metal perfluoroalkyl sulfonates; organosilicon surfactants such as modified polydimethylsiloxanes; and alkali metal soaps of modified resins.

Preferably, the external stabilizing surfactant is one that can react with a multivalent cation present in a neutral salt to form an insoluble multivalent cation water insoluble salt of an organic acid. Exemplary preferred surfactants include disodium octadecyl sulfosuccinimate, sodium dodecylbenzene sulfonate, sodium stearate and ammonium stearate.

The polyurethane dispersion may be prepared by any suitable method such as those well known in the art. (See, for example, U.S. Pat. No. 5,539,021, column 1, lines 9 to 45, which teachings are incorporated herein by reference.)

When making the polyurethane dispersion, the prepolymer may be extended by water solely, or may be extended using a chain extender such as those known in the art. When used, the chain extender may be any isocyanate reactive diamine or amine having another isocyanate reactive group and a molecular weight of from about 60 to about 450, but is preferably selected from the group consisting of: an aminated polyether diol; piperazine, aminoethylethanolamine, ethanolamine, ethylenediamine and mixtures thereof. Preferably, the amine chain extender is dissolved in the water used to make the dispersion.

In a preferred method of preparing the nonionizable polyurethane dispersion, a flowing stream containing the prepolymer is merged with a flowing stream containing water with sufficient shear to form the polyurethane dispersion. An amount of a stabilizing surfactant is also present, either in the stream containing the prepolymer, in the stream containing the water, or in a separate stream. The relative rates of the stream containing the prepolymer (R2) and the stream containing the water (R1) are preferably such that the polydispersity of the HIPR emulsion (the ratio of the volume average diameter and the number average diameter of the particles or droplets, or Dv/Dn) is not greater than about 5, more preferably not greater than about 3, more preferably not greater than about 2, more preferably not greater than about 1.5, and most preferably not greater than about 1.3; or the volume average particle size is not greater than about 2 microns, more preferably not greater than about 1 micron, more preferably not greater than about 0.5 micron, and most preferably not greater than about 0.3 micron. Furthermore, it is preferred that the aqueous polyurethane dispersion be prepared in a continuous process without phase inversion or stepwise distribution of an internal phase into an external phase.

The surfactant is sometimes used as a concentrate in water. In this case, a stream containing the surfactant is advantageously first merged with a stream containing the prepolymer to form a prepolymer/surfactant mixture. Although the polyurethane dispersion can be prepared in this single step, it is preferred that a stream containing the prepolymer and the surfactant be merged with a water stream to dilute the surfactant and to create the aqueous polyurethane dispersion.

The dispersion may have any suitable solids loading of polyurethane particles, but generally the solids loading is between about 1% to about 30% solids by weight of the total dispersion weight to facilitate the impregnation into the textile. Preferably the solids loading is at least about 2%, more preferably at least about 4% and most preferably at least about 6% to preferably at most about 25%, more preferably at most about 20% and most preferably at most about 15% by weight.

The dispersion may also contain a rheological modifier such as thickeners that enhance the ability of the dispersion to be retained in the textile prior to coagulation. Any suitable rheological modifier may be used such as those known in the art. Preferably, the rheological modifier is one that does not cause the dispersion to become unstable. More preferably, the rheological modifier is a water soluble thickener that is not ionized. Examples of useful rheological modifiers include methyl cellulose ethers, alkali swellable thickeners (e.g., sodium or ammonium neutralized acrylic acid polymers), hydrophobically modified alkali swellable thickeners (e.g., hydrophobically modified acrylic acid copolymers) and associative thickeners (e.g., hydrophobically modified ethylene-oxide-based urethane block copolymers). Preferably the rheological modifier is a methylcellulose ether. The amount of thickener may be any useful amount. Typically the amount of thickener is at least about 0.1% to about 5% by weight of the total weight of the dispersion. Preferably the amount of thickener is between about 0.5% to about 2% by weight.

Other additives such as those known in the art may be added to the polyurethane dispersion to impart some desired characteristic such as enhanced softness or improved ultraviolet stability.

Generally, the dispersion will have a viscosity that easily impregnates the textile while also being easily retained within the textile. Generally the viscosity is from at least about 100 centipoise (cp) to at most about 10,000 cp. Preferably, the viscosity is at least about 500 cp to at most about 5000 cp. More preferably, the viscosity is at least about 1000 cp to at most about 3000 cp.

After the textile is impregnated with the aqueous polyurethane dispersion, the dispersion is coagulated by exposing the impregnated textile to water containing a coagulant for a coagulation time sufficient to coagulate the dispersion. The textile may be exposed to the water containing the coagulant by any suitable method such as those known in the art.

Preferably, the impregnated textile is immersed in a water bath having a dissolved coagulant for a coagulation time sufficient to coagulate the polyurethane dispersion in the textile. Sufficiently coagulated is generally when further amounts of time result in at most a small amount more of polyurethane being coagulated within the textile. As an illustration, sufficiently coagulated is when further coagulation results in only about at most 10% by weight more polyurethane in the textile.

Surprisingly, the coagulation time is on the order of seconds compared to many minutes for internally stabilized polyurethane dispersions using much harsher chemicals and conditions. Generally, the coagulation time of 60 seconds is more than sufficient to coagulate the polyurethane dispersion at or near typical ambient conditions. Preferably, the coagulation time is at most about 30 seconds, more preferably at most about 20 seconds, even more preferably at most about 15 seconds and most preferably at most about 10 seconds.

The coagulant may be any compound, such as a monovalent or multivalent neutral salt, that is capable of being dissolved in water and causes the nonionizable aqueous polyurethane dispersion to coagulate as described in the previous paragraph (coagulate at room temperature in less than about 60 seconds). Preferably, the coagulant is a neutral salt that at least in part reacts with the externally stabilizing surfactant to form an insoluble salt of an organic acid. Desirably, the insoluble salt results from the reaction of multivalent cation replacing, for example, a monovalent cation of a surfactant, thus producing a multivalent cation water insoluble salt of an organic acid. Examples of neutral salts include sodium chloride, silver chloride, silver bromide, silver iodide, silver chromate, barium carbonate, barium fluoride, calcium carbonate, magnesium carbonate, silver nitrate, copper sulfate, magnesium nitrate, calcium nitrate, strontium nitrate and barium nitrate. Preferably, the coagulant is an alkaline earth salt. More preferably, the coagulant is an alkaline earth nitrate. Most preferably, the coagulant is a calcium salt such as calcium nitrate.

After coagulating, the textile may be washed/leached, for example, with water to remove excess salts and other compounds such as thickeners. Prior to the leaching of the textile, excess liquid may be removed, for example, by passing the textile through rollers in a similar fashion as described previously. The textile then may be leached by any suitable fashion such as immersing it in a water bath for a time of about 1 second to 20 minutes. Preferably the time is from about 1 minute to about 10 minutes.

Finally, the leached, coagulated, impregnated textile again may have excess liquid removed by rollers, followed by drying form the synthetic leather. The drying may be performed at any suitable temperature and time so long as the temperature is not so great such that the synthetic leather begins to decompose. Generally, the temperature is at least about 50° C. to about 200° C. Preferably, the temperature is about 75° C. to about 150° C.

In a preferred embodiment, the resultant synthetic leather is comprised of a textile having a plurality of fibers wherein the textile has therein a polyurethane and a multivalent cation substantially water insoluble salt of an organic acid (e.g., sulfonates, sulfates, and carboxylates). Examples of multivalent cation water insoluble salts include multivalent cation salts of organic acids selected from the group consisting of butyric acid, hexanoic acid, octanoic acid, decanoic acid, dodecanoic acid, lauric acid, myristic acid, palmitic acid, oleic acid, linoleic acid, stearic acid, linolenic acid, gum rosin, wood rosin, tall oil rosin, abietic acid, oxidized polyethylene containing carboxylic acid groups, ethylene-acrylic acid copolymers, ethylene-methacrylic acid copolymers, polyolefins grafted with unsaturated carboxylic acids, polyolefins grafted with anhydrides, methacrylic acid, maleic acid, fumaric acid, acrylic acid, and alkylbenzene sulfonic acid.

Other examples include multivalent cations reacted with alkali metal lauryl sulfates; amine lauryl sulfates such as triethanolamine lauryl sulfate; quaternary ammonium surfactants; alkali metal alkylbenzene sulfonates such as branched and linear sodium dodecylbenzene sulfonates; amine alkyl benzene sulfonates such as triethanolamine dodecylbenzene sulfonate; anionic and nonionic fluorocarbon surfactants such as fluorinated alkyl esters and alkali metal perfluoroalkyl sulfonates; organosilicon surfactants such as modified polydimethylsiloxanes; and alkali metal soaps of modified resins. Preferably, the multivalent cation water insoluble salt is one where the cation is an alkaline earth that has reacted with disodium octadecyl sulfosuccinimate, sodium dodecyl benzene sulfonate, sodium stearate and ammonium stearate.

The multivalent cation is preferably an alkaline earth cation. More preferably, the multivalent cation is Ca, Mg or Sr. Most preferably, the multivalent cation is Ca.

The amount of multivalent cation remaining in the synthetic leather may vary over a wide range, but typically is from about 10 ppm to 20,000 ppm by weight of the synthetic leather. Preferably, the amount of the multivalent cation in the synthetic leather is at least about 20, more preferably at least about 50 and most preferably at least about 100 ppm to preferably at most about 10,000 ppm, more preferably at most about 5000 ppm and most preferably at most about 2500 ppm by weight of the synthetic leather. The amount of the multivalent cation may be determined by known methods such as neutron activation analysis.

The synthetic leather may be used as is or may be used as a supporting layer for synthetic leather having a poromeric layer thereon. When used as a supporting layer, the poromeric layer that is applied may be any polymer suitable in the art of making synthetic leather poromeric layers, such as polyurethane, polyvinylchoride, ethylene vinylacetate, nitrile rubber, styrene-butadiene, styrene-isoprene, methyl acrylate, butyl acrylate, octyl acrylate, 2-ethyl-hexyl acrylate, natural rubber latex, elastomeric polyolefin and mixtures thereof. The poromeric layer may be applied and formed by any suitable method such as those known in the art. Preferably, the poromeric layer is formed by mechanically frothing a polymeric dispersion and applying it using a suitable method such as doctor blading.

When making a synthetic leather with a poromeric layer, it has been surprisingly found that an aqueous polyurethane dispersion may be used to form a synthetic leather with a poromeric layer having excellent hand, appearance and properties. To make such a synthetic leather, a frothed aqueous polyurethane dispersion is applied onto a textile that has preferably been impregnated with a polymer, wherein the aqueous polyurethane dispersion has an externally stabilizing surfactant. The applied frothed aqueous polyurethane dispersion is then heated to a temperature sufficient to dry and cure frothed dispersion to form the synthetic leather having a poromeric layer.

For the hand, appearance and properties to be developed, the poromeric layer must be formed by heating to dry and cure the poromeric layer without any coagulants after it has been applied. It is critical to fixate the poromeric layer by heating to retain uniform spherical porosity of the froth so as to achieve the appearance and properties desired.

The aqueous dispersion used to make the poromeric layer may be an internally stabilized or externally stabilized polyurethane dispersion so long as there is an external surfactant present. It is understood that the external surfactant present in an internally stabilized dispersion is used to stabilize the froth where in an externally stabilized polyurethane dispersion it is used not only to stabilize the froth, but the polyurethane colloid particles themselves. It is preferred to use the externally stabilized polyurethane dispersion described herein for making the impregnated textile synthetic leather because of its ability to be made essentially free of an organic solvent. This is in contrast to internally stabilized polyurethane dispersions, which invariably require the use of some organic solvent because of the viscous nature of the prepolymers needed to make them.

When making the poromeric layer, it is preferred to use at least two external stabilizing surfactants in the aqueous polyurethane dispersion to aid in forming the froth. It is preferred for one of the surfactants to be amphoteric. Preferably, the amphoteric surfactant is a betaine such as cocamidopropyl betaine. Other surfactants useful in preparation of the poromeric layer are the same as previously described.

The aqueous polyurethane dispersion may be frothed by any suitable method, but preferably is frothed mechanically, for example, by methods known in the art. The frothed externally stabilized dispersion may be applied to a textile by any suitable method such as those known in the art (e.g., doctor blading). Preferably, the textile is an impregnated textile, such as those known in the art for forming synthetic leather. Preferably, the impregnated textile is the impregnated textile synthetic leather described herein.

After the frothed aqueous polyurethane dispersion has been applied to the textile it is heated for a time sufficient to dry and cure it. Generally, heating takes place as quickly as practicable to fix the desired cell structure described below. The temperature may be any temperature suitable so long as the desired cell structure is retained and none of the components of the synthetic leather are decomposed. For example, the temperature is typically at least about 50° C. to at most about 250° C. Preferably the temperature is at least about 75° C., more preferably at least about 100° C. and most preferably at least about 110° C. to preferably at most about 225° C., more preferably at most about 200° C. and most preferably at most about 150° C. The heating time is desirably as short as practicable. Typical heating times range between seconds up to 1 hour. Any suitable heating method or heating energy source may be used such as a convection oven, heating plates, infrared oven, microwave heating or combination thereof.

Surprisingly, the resultant synthetic leather's poromeric layer may have uniform spherical morphology compared to poromeric layers made using a coagulant or made using solvent. For example, the poromeric layer has about 2000 to 300,000 cells per square centimeter viewing a cross section of the layer. Generally, spherical morphology means the aspect ratio of the cells is generally less than or equal to about 5. Preferably, the pores have an aspect ratio of at most about 4.5, more preferably at most about 4 and most preferably at most about 3.5. The aspect ratio is determined by measuring the shortest and longest feret lengths of at least about 100 cells, for example, using image analysis software on an SEM micrograph. Suitable software includes, for example, "Leica QWin", Leica Microsystems AG, Wetzlar, Germany.

Generally, the average pore size is about 300 $\mu m^2$ to at most about 49000 $\mu m^2$ as determined by measuring the area of about 100 pores randomly using the method(s) described in the previous paragraph. Preferably, the average pore size is at least about 500 μm2, more preferably at least about 1000 $\mu m^2$, most preferably at least about 2000 μm2 to preferably at most about 30000 μm2, more preferably at most about 25000 μm2 and most preferably at most about 20000 $\mu m^2$ by number.

In a preferred embodiment, the synthetic leather having the poromeric layer is leached after heating. It has been surprisingly found that the leaching of the poromeric layer simply with water increases the wet ply adhesion of the synthetic leather, while improving the hand, appearance and suppleness. For example, the wet ply adhesion before leaching typically is at most about 0.8 kg/cm, whereas after leaching, the wet ply adhesion is at least about 1.5 kg/cm. Preferably, the wet ply adhesion is at least about 2 kg/cm, more preferably at least about 2.5 kg/cm, even more preferably at least about 2.7 kg/cm, most preferably at least about 3.0 kg/cm.

Generally, to see improved wet ply adhesion, at least about 10% by weight of the surfactant should be removed. More preferably, at least about 50% by weight of the surfactant is removed and most preferably at least about 70% by weight of the surfactant is removed from the poromeric layer. The amount of surfactant removed may be determined by know methods such as liquid chromatography and mass spectroscopy.

Generally, the amount of surfactant present in the poromeric layer is at most about 4% by weight of the poromeric layer. Preferably, the amount of surfactant in the poromeric layer is at most about 3%, more preferably at most about 2.5%, even more preferably at most about 1.5% and most preferably at most about 1% by weight of the poromeric layer.

The leaching is performed by any suitable method of contacting the poromeric layer with water. For example, the synthetic leather with poromeric layer may be immersed in water or sprayed with water. The leaching time may be any suitable to achieve the appearance, hand and properties such as described above. Illustratively, the leaching time may be a few seconds to an hour or two. Preferably the leaching time is on the order of a couple of minutes to 10 or 20 minutes.

For any of the polyurethane dispersions of the present invention may use other known fillers such as fillers and pigments. In addition, the synthetic leather may have other layers such as a UV protective layer, tactile (touch/feel) modification layer and anti-aging layer.

EXAMPLES

Example 1

A nonwoven textile was completely immersed in an aqueous polyurethane dispersion for about 5 seconds, then removed allowing excess liquid to drain out of the immersed textile. The textile was an 80:20 blend of 1.5 denier polyester fiber and 2.0 denier polyamide fiber formed by the needle punch process. The textile had a thickness of about 1 mm and a weight of about 213 $g/m^2$.

The polyurethane dispersion was an externally stabilized polyurethane dispersion was made by the procedure and materials described in Example 4 of WO 00/61651 (U.S. Ser. No. 09/548,822) formerly available under the tradename INTACTA 1000 (The Dow Chemical Company, Midland, Mich.) that had been diluted with water to form a dispersion having 10% by weight of polyurethane particles. This aqueous polyurethane dispersion prepared by process essentially free of any solvent. Prior to dilution, the dispersion had a polyurethane solids loading of about 45 percent by weight.

The diluted dispersion was thickened by adding 10 parts by weight METHOCEL® 228 (The Dow Chemical Company, Midland, Mich.) to 1000 parts by weight of the diluted polyurethane dispersion, which had been adjusted to a pH of between about 8 to 10 using ammonium hydroxide. The thickened dispersion had a viscosity of about 1500 centipoise.

The soaked textile was then passed through rubber coated nip rollers at a speed of about 6 m/min with the roller pressure being about 2 bar. The nipped textile was then completely submerged for about 5 seconds in a 10% by weight calcium nitrate solution at room temperature to coagulate the polyurethane dispersion within the textile. The textile, after coagulating, was again passed through the rubber nip rollers at the same speed and pressure previously described. The impregnated coagulated textile was then immersed into a water bath for about 5 minutes to leach water soluble components from the textile. After allowing excess water to drain the leached textile was again passed through the rubber nip rollers as before. Finally, after leaching the textile is placed in an oven at 130° C. until the textile reaches a temperature of 110° C. as determined by an infrared pyrometer to form the impregnated synthetic leather.

The synthetic leather had polyurethane content of about 35 g/m$^2$. The synthetic leather had excellent softness, suppleness and hand. The microstructure that was developed is shown in FIG. 1. The amount Ca remaining in the synthetic leather was 500 ppm by weight, which has been attributed to the surfactant reacting to form a calcium dodecylbenzene sulfonate.

Example 2

The same procedure as described in Example 1 was used to form an impregnated synthetic leather, except that a 10% by weight NaCl water solution was used as the coagulating bath and the coagulation time was about 5 minutes.

Figure 2:
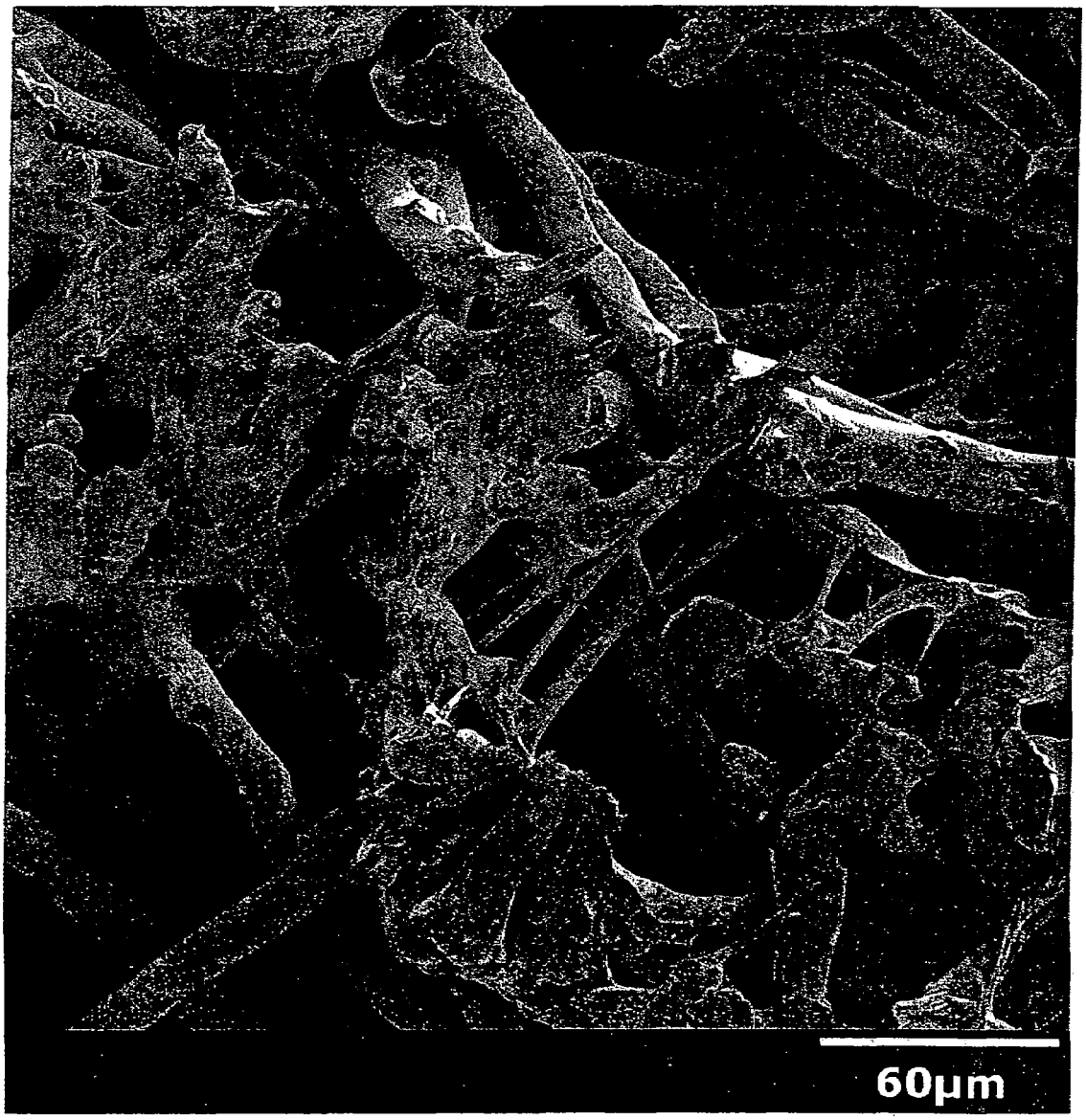
FIG. 2 is an SEM micrograph of a synthetic leather of the present invention where the polyurethane dispersion was coagulated for about 5 minutes using a 10% by weight sodium chloride aqueous solution.

The synthetic leather had polyurethane content of about 32.3 g/m$^2$. The synthetic leather had excellent suppleness, softness and hand. The microstructure of this impregnated synthetic leather is shown in FIG. 2.

Example 3

The same procedure as described in Example 1 was used to form an impregnated synthetic leather, except that a 10% by weight NaCl and acetic acid water solution having a pH of about 3.6 was used as the coagulating bath.

Figure 3:
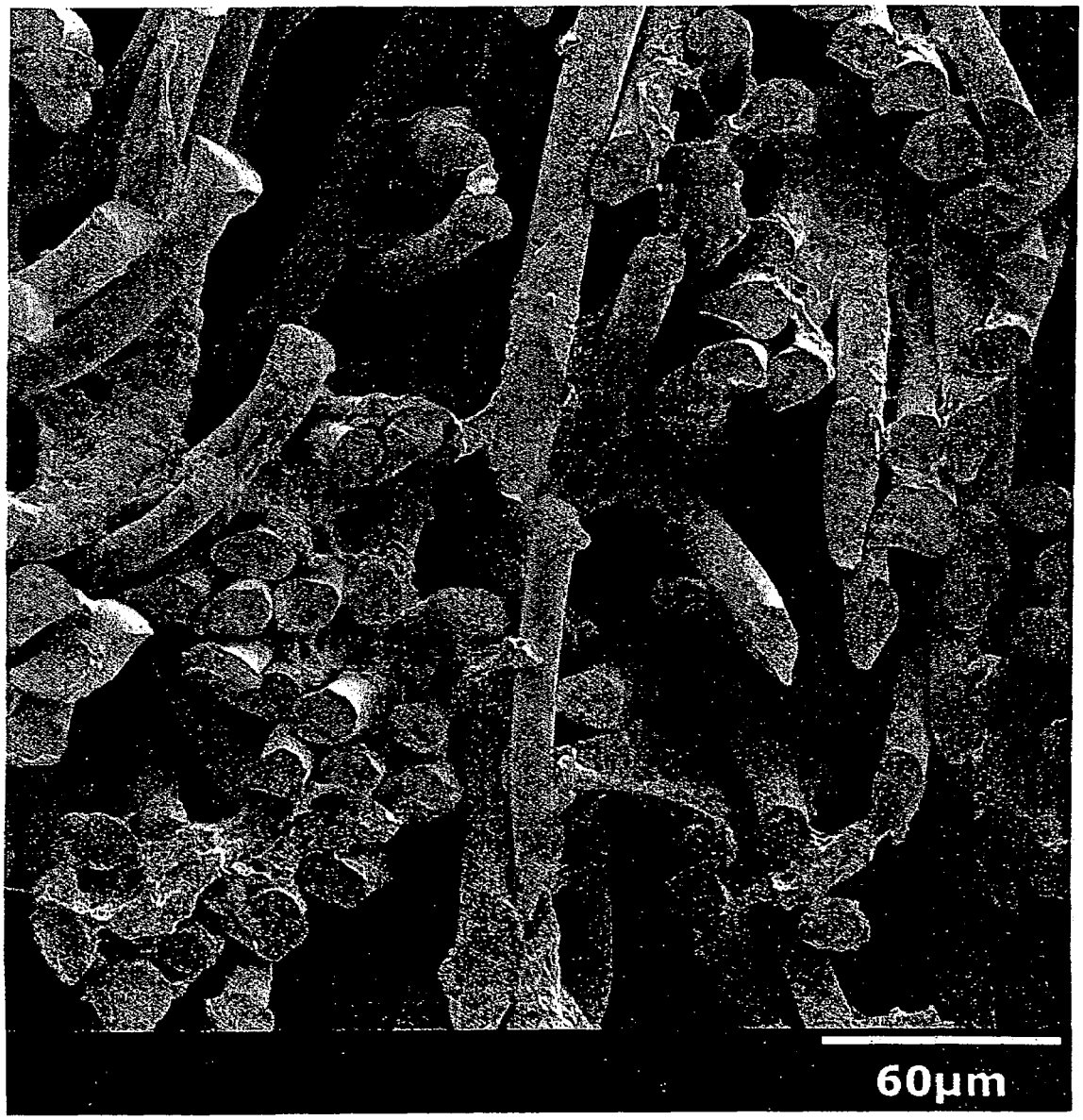
FIG. 3 is an SEM micrograph of a synthetic leather of the present invention where the polyurethane dispersion was coagulated for about 5 seconds using sodium chloride and acetic acid aqueous solution.

The synthetic leather had polyurethane content of about 32.3 g/m$^2$. The synthetic leather had excellent suppleness, softness and hand. The microstructure of this impregnated synthetic leather is shown in FIG. 3.

Example 4

An impregnated synthetic leather was made using the method described in Example 1. A polyurethane poromeric layer was applied to the impregnated synthetic leather as follows.

A frothing polyurethane dispersion was prepared by blending 180 parts by weight of an externally stabilized polyurethane dispersion (DYL 100.01 Developmental Polyurethane Dispersion available from The Dow Chemical Company) with the additives described in the next paragraph. The DYL 100.01 dispersion was prepared as described in Example 1 of U.S. Pat. No. 6,271,276.

The frothing polyurethane dispersion had a solids content of about 55% by weight with 3 dry parts by weight (pbw) ammonium stearate (STANFAX 320, Para-Chem Standard Division, Dalton, Ga.), 1 pbw disodium octadecyl sulfosuccinimate (STANFAX 318, Para-Chem), 1 pbw cocamidopropyl betaine (STANFAX 590, Para-Chem), 10 pbw titanium dioxide (Ti-Pure® R-706, DuPont, Wilmington, Del.), and 0.8 pbw acrylic acid copolymer thickner (ACUSOL 810A, Rohm and Haas, Philadelphia, Pa.) such that the dispersion had about 46% by weight water. The pH of the frothing polyurethane dispersion was about 10 and the viscosity was about 14,300 centipoise.

To make a synthetic leather having a poromeric layer, the impregnated synthetic leather was attached to a pin frame. The frothing polyurethane dispersion was frothed using a Model 2MT1A foam machine (E.T. Oakes Corp., Hauppauge, N.Y.) run at 800 rpm, air flow of 0.06 slpm and a dispersion flow rate of 240 g/min. The wet froth density was about 840 g/l. The froth was applied to the impregnated synthetic leather using a Labcoater type LTE-S (Werner Mathis AG, Concord, N.C.). The doctor knife was positioned about 0.78 mm above the impregnated synthetic leather. The frothed dispersion was dispensed and the doctor bladed to form a coating of frothed polyurethane dispersion on the impregnated synthetic leather. The coated impregnated synthetic leather was then placed in an oven at 80° C., which was then heated to 150° C. in about 11 minutes to form the synthetic leather having a poromeric layer thereon.

The synthetic leather had wet a ply adhesion of about 0.8 kg/cm.

The wet ply adhesion was determined as follows. A 5"×6" piece of synthetic leather was cut out of a large synthetic leather sheet, and then glued on a similar size of rubber slab using a solvent based polyurethane adhesive. The rubber was a low elongation type. The thickness of rubber was approximately 2.5 mm. After curing the glue overnight at room temperature, two 1"×6" pieces of glued synthetic leather samples were cut out for testing. Prior to test, each 1"×6" sample was submerged into a container of deionized water for ten minutes. The sample was then taken out of water container. Excessive water on the samples was gently pat off using paper towel. The sample was then mounted onto the two grips of an Instron machine for testing (Instron 5581, Instron Corporation, Canton, Mass.). The pulling speed of Instron machine was 2 in/min. The force to separate the two plys of synthetic leather was recorded. The lowest forces recorded at each 2 inch interval of separation between the two plys were averaged to give the wet ply adhesion in kg/cm.

Example 5

A synthetic leather having a poromeric layer thereon by the same method as described in Example 4 except that after the drying/curing the synthetic leather, it was immersed in water at a temperature of about 70° C. for about 4 minutes to leach out soluble components such as surfactants from the poromeric layer. The leached synthetic leather is passed through the nip rollers under the same conditions described in Example 1 and then dried in an oven at 130° C.

The synthetic leather having a poromeric layer thereon had a wet ply adhesion of about 2.8 kg/cm.

Comparative Example 1

An impregnated synthetic leather was made using the same procedure as described in Example 1 except that the polyurethane dispersion was an internally stabilized polyurethane dispersion WITCOBOND W-290H available from Witco Corporation, Perth Amboy, N.J.

The dispersion failed to coagulate and no polyurethane remained in the textile.

Comparative Example 2

An impregnated synthetic leather was made using the same procedure as described in Example 2 except that the polyurethane dispersion was the same as used in Comparative Example 1.

The dispersion failed to coagulate and no polyurethane remained in the textile.

Comparative Example 3

An impregnated synthetic leather was made using the same procedure as described in Example 3 except that the polyurethane dispersion was the same as used in Comparative Example 1.

The synthetic leather had polyurethane content of 0.15 $g/m^2$. From this number it is readily apparent that the dispersion failed to coagulate.

Comparative Example 4

An impregnated synthetic leather was made using the same procedure as described in Comparative Example 3.

The synthetic leather had polyurethane content of 1.2 $g/m^2$. From this number it is readily apparent that the dispersion had just begun to coagulate.

From the results, it is readily apparent that a nonionizable polyurethane having an external stabilizing surfactant as in the Examples coagulates in a time on the order of seconds whereas internally stabilized polyurethane dispersions require 5 or more minutes to coagulate to the same extent.

What is claimed is:

1. A method for making an impregnated textile synthetic leather, the method comprising:

(a) impregnating a non-woven or woven textile with an externally stabilized dispersion of a nonionizable polyurethane and an external stabilizing surfactant, wherein the nonionizable polyurethane substantially fails to have ionic or nonionic hydrophilic pendant groups, and the polyurethane dispersion is not mixed with another dispersion or emulsion; and (b) exposing the impregnated textile to water containing a coagulant for a coagulation time sufficient to coagulate the dispersion wherein the coagulant is a multivalent cation neutral salt.

2. The method of claim 1, wherein the method is carried out in an environment containing less than about 2000 parts per million by weight of an organic solvent.

3. The method of claim 1, wherein the method is carried out essentially free of an organic solvent.

4. The method of claim 1, wherein the coagulant is an alkaline earth cation salt.

5. The method of claim 4, wherein the coagulant is calcium nitrate, magnesium nitrate, strontium nitrate and barium nitrate or mixture thereof.

6. The method of claim 1, wherein the coagulation time is at most 2 minutes.

7. The method of claim 6, wherein the coagulation time is at most 1 minute.

8. The method of claim 7, wherein the coagulation time is at most 30 seconds.

9. The method of claim 1, further comprising leaching the impregnated textile after step (b) by exposing the impregnated textile to water.

10. The method of claim 1, wherein the dispersion of the nonionizable polyurethane contains a thickener.

11. The method of claim 10 wherein the thickener is water soluble thickener that is not ionizable.

12. The method of claim 11 wherein the thickener is a methylcellulose ether.

13. The method of claim 1 further comprising applying a frothed polymeric dispersion after step (b) to form a synthetic leather having a poromeric layer thereon.

14. The method of claim 13 wherein the frothed polymeric dispersion is an aqueous externally stabilized polyurethane dispersion.

15. The method of claim 14 wherein the poromeric layer is heated sufficiently to dry and cure the poromeric layer and then is leached in water.

* * * * *